US005809737A

United States Patent [19]

Collier et al.

[11] Patent Number: 5,809,737

[45] Date of Patent: Sep. 22, 1998

[54] STRUCTURAL PARTS FOR USE IN AIRCRAFT

[75] Inventors: Alan Derek Collier; Stephen Harold Johnston; John Eastham, all of Balderstone, United Kingdom

[73] Assignee: British Aerospace PLC, Farmborough, United Kingdom

[21] Appl. No.: 573,970

[22] Filed: Dec. 15, 1995

[30] Foreign Application Priority Data

Dec. 16, 1994 [GB] United Kingdom ..... 9425447

[51] Int. Cl.[6] ..... E04C 2/34

[52] U.S. Cl. ..... 52/783.19; 52/729.5; 52/730.6; 52/793.1; 228/118; 228/181; 228/190; 428/178; 428/593; 428/594

[58] Field of Search ..... 52/783.19, 793.1, 52/729.2, 729.5, 730.6, 731.7; 228/118, 181, 190; 428/181, 586, 593, 594, 660

[56] References Cited

U.S. PATENT DOCUMENTS

| | | | |
|---|---|---|---|
| 3,185,112 | 5/1965 | Johnston | 52/783.19 X |
| 3,483,665 | 12/1969 | Miller | 52/729.5 X |
| 3,743,568 | 7/1973 | Wolf | 428/178 |
| 4,017,347 | 4/1977 | Cleveland | 428/178 X |
| 4,304,821 | 12/1981 | Hayase et al. . | |
| 4,351,470 | 9/1982 | Swadling et al. . | |
| 4,534,503 | 8/1985 | Stephen et al. . | |
| 4,607,783 | 8/1986 | Mansbridge et al. . | |
| 5,143,276 | 9/1992 | Mansbridge et al. . | |
| 5,715,644 | 2/1998 | Yasui | 52/784.14 |

FOREIGN PATENT DOCUMENTS

| | | | |
|---|---|---|---|
| 502620 | 9/1992 | European Pat. Off. . | |
| 2030480 | 4/1980 | United Kingdom . | |
| 2129340 | 5/1984 | United Kingdom . | |
| 2245218 | 1/1992 | United Kingdom | 428/178 |

*Primary Examiner*—Carl D. Friedman
*Assistant Examiner*—Timothy B. Kang
*Attorney, Agent, or Firm*—Cushman Darby & Cushman IP Group of Pillsbury Madison & Sutro LLP

[57] ABSTRACT

The present invention provides a method of making a frame, particularly for the aircraft industry, having a central member (34) and one or more cantilever ribs (32); such a frame can be made by forging or machining but these are time-consuming and expensive. According to the present invention such frames are made by diffusion bonding and superplastic forming techniques, whereby a pack of sheets are bonded together except in certain areas. Gas is injected into those areas to inflate the pack superplastically to form one or more closed cells (16). The top of the cells is then machined off along line 23, while the side walls of the cells are retained, to provide a frame having cantilever ribs (32).

7 Claims, 3 Drawing Sheets

STRUCTURAL PARTS FOR USE IN AIRCRAFT

TECHNICAL FIELD

The present invention relates to a beam, bar, strut or frame or some such similar structure, particularly for use in constructing aircraft that may be formed by diffusion bonding and superplastic forming (DB/SPF), particularly made from aluminium or titanium or alloys of either of these materials.

BACKGROUND ART

Generally, complex titanium structures can be made by machining a block of titanium to provide the desired structure, which is wasteful, time-consuming and expensive. Alternatively, such structures can be made by forging. The present invention provides a simpler and cheaper method for making such structures.

Combined diffusion bonding and superplastic forming is an established technique for making composite articles from materials which exhibit superplastic properties at elevated temperatures. These materials are primarily titanium, aluminium and alloys of both these metals. In established DB/SPF processes, e.g. as described in U.S. Pat. No. 5,143,276, it is known to apply stop-off material to selected areas of two or more sheets of superplastic material; several sheets, including the sheets to which stop-off material has been applied, are then assembled into a pack with the stop-off material lying between adjacent superplastic sheets. The assembled pack is then heated and compressed until the sheets are diffusion bonded together; however, the sheets are not bonded in the selected areas covered by stop-off material since the stop-off material prevents diffusion bonding in those areas. The superplastic forming step is then conducted by heating the bonded pack, usually in a mould, to a temperature at which the components exhibit superplastic properties. An inert gas is then injected in a controlled manner into the unbonded areas of the pack under high pressure so as to "inflate" the sheets gradually into a three dimensional structure having an outer shape corresponding to the shape of the mould. The configuration of the final composite structure is dependent upon, among other things, the number of sheets in the pack, the location of the stop-off material and the shape of the mould.

It is known, for example from GB-1495655, to form a composite panel from a pack comprising a pair of opposed face sheets and a core sheet sandwiched between, and bonded to, the face sheets; in the superplastic forming process, the face sheets are forced apart and because the internal core sheet is attached to both of the face sheets, the core sheet adopts a zigzag shape that, in effect, constitutes struts extending from one face sheet to the other.

U.S. Pat. No. -4,304,821 and U.S. Pat. No. -5,143,276 each describes the making of a panel from four sheets of superplastic material from a pack comprising a pair of opposed face sheets and two core sheets sandwiched between the face sheets; the two core sheets are bonded to each other by linear welds. The face sheets are superplastically formed by injecting gas into the area between each face sheet and the adjacent core sheet to expand the face sheets into the shape of a mould; gas is then injected between the two core sheets. Because the core sheets are joined by the linear welds, the core sheets expand to form cells extending between the face sheets; the side walls of the cells are formed by U-shaped doubled-back sections of the two core sheets.

GB-4129340, GB-2030480, U.S. Pat. No. -4,534,503, U.S. Pat. No. -4,607,783, U.S. Pat. No. -4,351,470 and EP-0502620 all disclose methods of forming hollow panels using DB/SPF techniques but none of them disclose the manufacture of a structure having cantilever ribs.

DISCLOSURE OF THE INVENTION

According to the present invention, there is provided a beam, bar, strut or frame or some such similar structure, particularly for use in constructing aircraft, comprising a central member and at least one cantilever rib extending outwardly therefrom, wherein the rib is formed by doubled-back portions of superplastically formable material that have been bonded together.

According to a second aspect of the present invention, there is provided a method of forming a beam, bar, strut or frame or some such similar structure, particularly for use in constructing aircraft, comprising a member (which is usually planar and preferably is in the form of a planar sheet) and at least one cantilever rib extending outwardly therefrom, which method comprises:

forming a stack or pack comprising the said member and at least one sheet of superplastic material, bonding the member and the superplastic sheet together around the perimeter of at least one area, the interface between the member and the sheet in the or each area including stopping-off material, superplastically forming the sheet by injecting inert gas into the said area(s) to form a composite structure comprising the member and the superplastically-formed sheet that together form a plurality of closed cells, the cells comprising side walls and an outer wall, the side walls being composed of doubled-back portions of the superplastic sheet and trimming the outer wall of the cells and optionally also part of the side walls to form the said structure, the said cell side wall(s) forming the rib(s) of the structure.

By the term "cantilever rib" used in this specification, we mean that the rib is joined at one end (the proximate end) to the central member but the end of the rib remote from the proximate end (the distal end) is free. The rib may, as discussed below, be formed as a loop, i.e. to form the side walls of an open-topped cell, several such cells may be provided in which case adjacent cells may share a common side wall or rib. It will naturally be appreciated that, in the above method, the stopping-off material in the said area(s) prevents diffusion bonding within the area(s) during superplastic forming.

Using the above method, it is possible to form a structure, e.g. a frame for an aircraft, using considerably less material than is necessary in the conventional machining of that structure from a solid billet. Since the material used in aircraft is expensive, e.g. titanium, the resulting saving in material costs can be significant.

The ribs can be formed on only one side of the central member or on both sides. If formed on both sides, the pack will comprise two superplastically formable sheets sandwiching the member between them. If there are ribs on both sides of the central member, they can be located opposite one another or they may be staggered, according to the required design of the structure.

The side walls of each cell can provide a continuous rib extending around the perimeter of the stopped-off area. If the whole of this side wall is not required to form a rib in the final structure, then part of the side wall can be machined off.

The material forming the ribs should have superplastic properties at an elevated temperature, for example titanium and aluminium and alloys thereof. The central member may also have superplastic properties but it is not essential that it does.

The two individual thicknesses of superplastic material that constitute the doubled-back ribs may lie adjacent to each other or a spacer or reinforcing member may be included between them, as described in U.S. Pat. No. 4,351,470.

DESCRIPTION OF THE DRAWINGS

The invention will be further described, by way of example only, with reference to the accompanying drawings in which:

FIG. 10 shows the shape of a conventional billet from which the frame of FIG. 6 could be machined from.

DETAILED DESCRIPTION OF THE PREFERRED EMBODIMENTS

Figure 1:
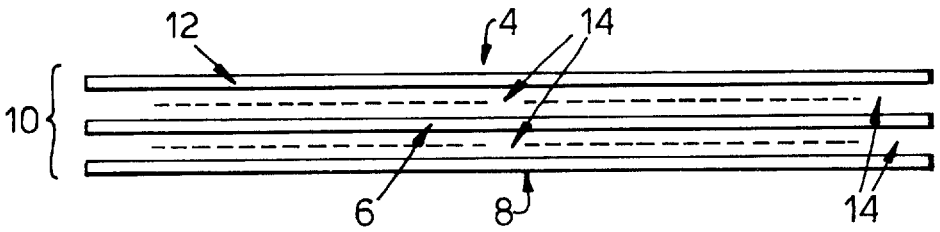
FIG. 1 shows a pack of titanium sheets that can be used in the present invention.
Figure 2:
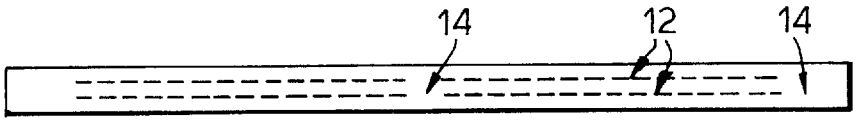
FIG. 2 shows the pack of sheets of FIG. 1 after they have been bonded together.

Referring to the accompanying Figures, and initially to FIG. 1, a stack or pack 10 composed of three sheets 4,6,8 is assembled, the sheets being made of a material that has superplastic properties at elevated temperature, for example titanium, aluminium or alloys thereof. Stop-off material. e.g. silica, is applied to selected areas 12 between adjacent sheets of the pack to prevent diffusion bonding of the pack in those selected areas. Other areas 14 are not covered by stop-off material.

The assembled pack of sheets 10 is then placed in a heated press (not shown) and compressed at a temperature and for a time sufficient to diffusion bond the sheets of the pack together in areas 14 that are not covered by stop-off material. Instead of diffusion bonding, the sheets of the pack may be bonded together in the said selected areas by other means, for example explosion bonding or welding but diffusion bonding is preferred.

Gas supply pipes (not shown) are provided in the bonded pack 10 to supply inert gas to the selected areas 12 within the pack for superplastic forming. In order to facilitate the supply of inert gas to all the areas 12 within the pack, adjacent areas can be connected together, as is known, by openings within the pack 10.

Figure 4:
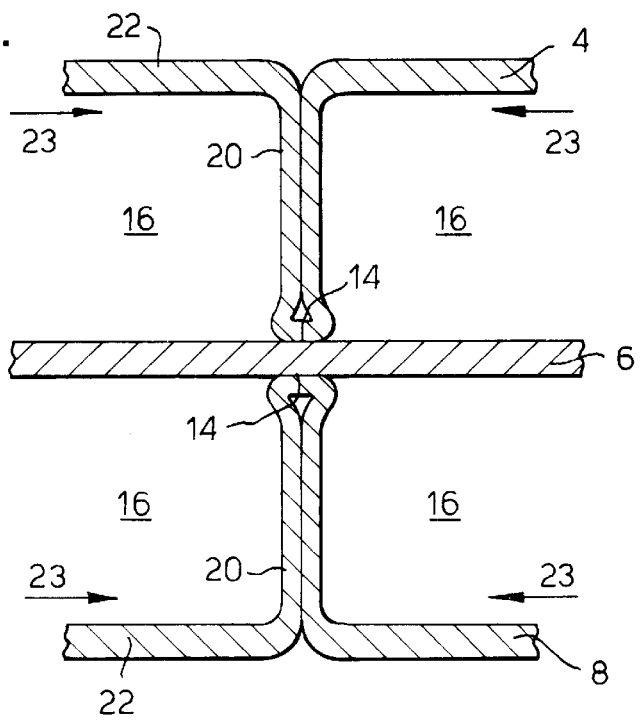
FIG. 4 shows a detailed cross section of part of the panel of FIG. 3.

The bonded pack 10 is then placed in a superplastic forming mould (not shown) and using well known superplastic forming techniques, inert gas is injected into the stopped off areas 12 of the pack to "inflate" the outer sheets 4,8 of the pack to conform to the internal shape of the superplastic forming mould. During superplastic forming a number of generally rectilinear closed cells 16 are formed on either side of the inner core sheet 6, the cells having side walls 20 and an outer wall 22. As can be seen in FIG. 4, which shows a detailed section of the panel, the superplastic forming process forces part of the outer sheets 4 and 8 away from the central core sheet 6: however, in the regions 14 where the outer sheets 4.,8 are bonded to the core sheet, the outer sheets cannot move away from the core sheet 6 and so the outer sheets stretch and form folded-back double-thickness side walls centred about the bonds 14. The superplastic forming process is performed in such a way that the two thicknesses of the side walls 20 are diffusion bonded together to form a single composite wall.

During the superplastic forming process, the core sheet 6 remains in substantially its original planar shape.

Figure 5:
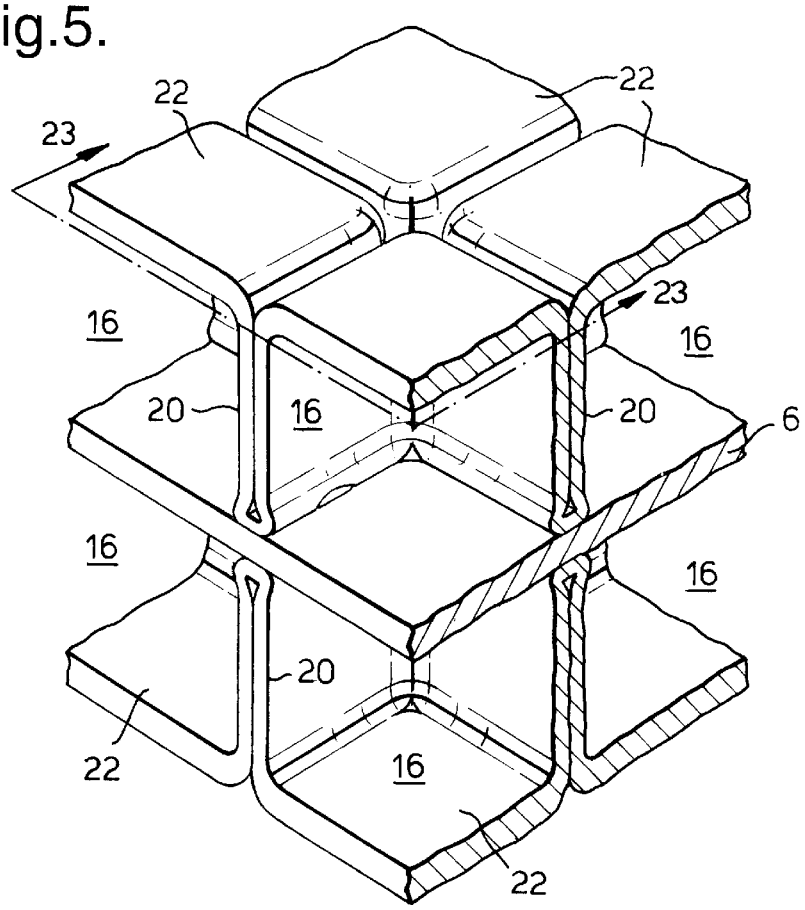
FIG. 5 shows an isometric view of the panel of FIGS. 3 and 4.

An isometric view of the panel is shown in FIG. 5.

Figure 6:
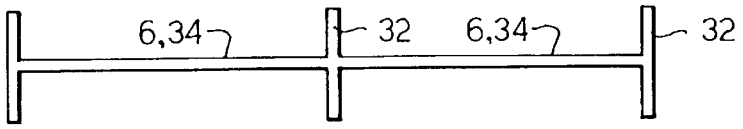
FIG. 6 shows a cross sectional view of the panel of FIGS. 3 to 5 after it has been machined to form a structural frame.

The panel can be formed into a structural frame suitable for constructing aircraft by removing selected areas of the or each cell. In order to form a structure with a central member and ribs extending outwardly therefrom, the outer wall 22 can be removed by machining along lines 23 shown schematically in FIGS. 3 to 5. After removal of the outer wall 22 of each cell 16 the structure is as shown in FIG. 6.

Figure 7:
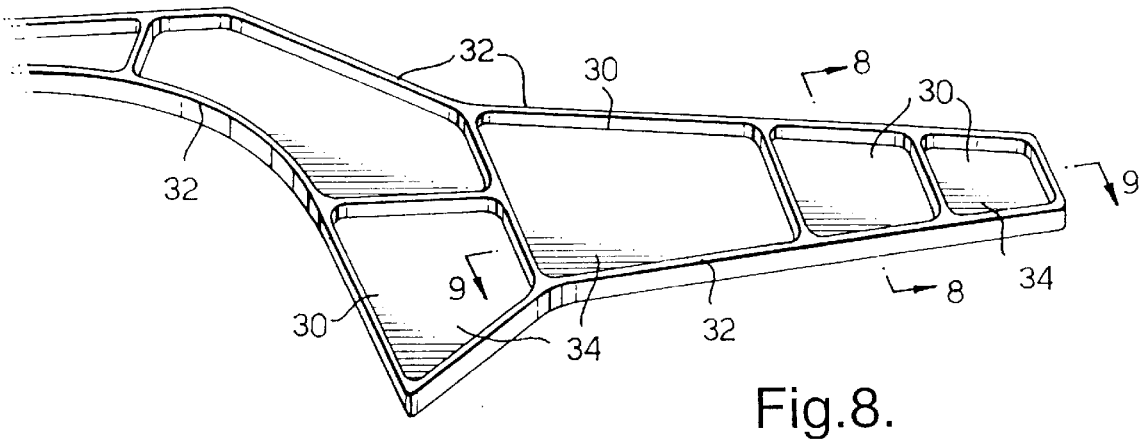
FIG. 7 shows part of a structural frame for an aircraft formed according to the method of the present invention.

FIG. 7 shows part of an aircraft frame formed using the present invention; it consists of a number of open cells 30 each being bounded by a perimeter rib 32, formed on either side of a central sheet 34. The central sheet 34 corresponds to the core sheet 6 in the original superplastically-formed pack of FIGS. 1 to 6 and the ribs 32 correspond to the side walls 20 of the superplastically formed cells 16. It will be appreciated that the frame shown in FIG. 7 is formed by the above superplastic forming process and involves removing the outer walls 22 shown in FIG. 3 to arrive at the structure shown in FIG. 7. In order to reduce the weight of the frame, it is possible to machine away part of the central sheet 34 within the perimeter ribs, which also allows for the accommodation of aircraft systems and/or the passage of communication ducts through the frame.

As well as providing strength to the frame, the ribs are well adapted for attachment of other aircraft components and/or structural walls to enable a complete aircraft to be built up.

Figure 8:
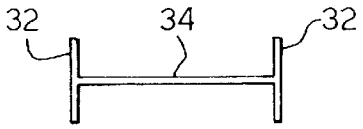
FIG. 8 shows a cross sectional view of the frame of FIG. 7 along the line 8—8.
Figure 9:
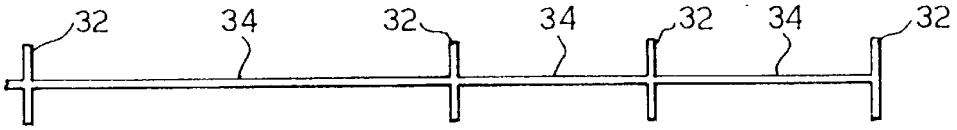
FIG. 9 shows a cross sectional view of the frame of FIG. 7 along the line 9—9.

Sections along the lines 8—8 and 9—9 of FIG. 7 are shown in FIGS. 8 and 9.

Figure 3:
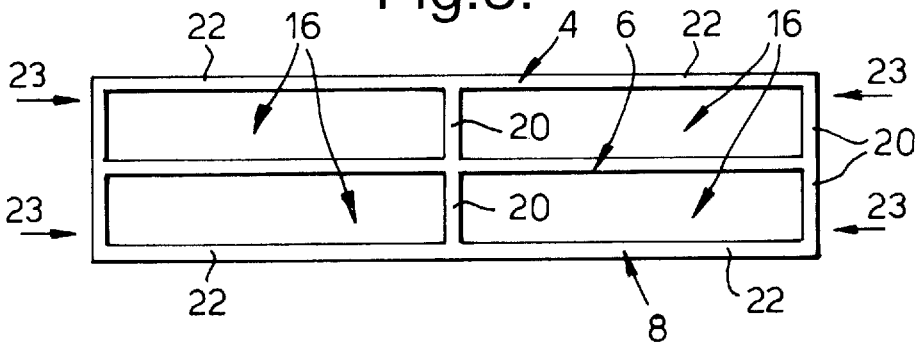
FIG. 3 shows a panel that has been superplastically formed from the bonded pack of FIG. 2.
Figure 10:
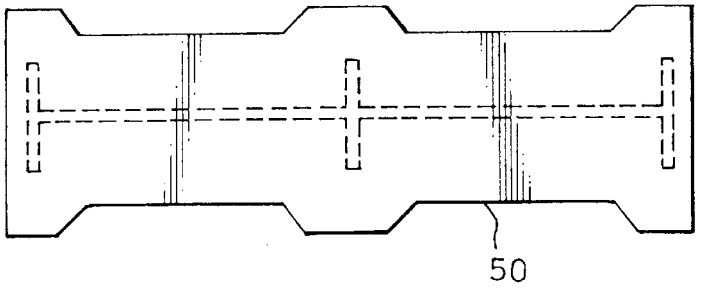
Fig.10. PRIOR ART

The manufacture of a frame according to the present invention shows considerable saving of material as compared to the conventional machining of parts from solid billets; a solid billet 50 from which the structure of FIG. 3 can be machined is shown in FIG. 10.

Using conventional techniques, the frame of an aircraft had to be constructed by joining together various frame parts using fasteners but such fasteners are not necessary, as will be appreciated, in constructing the frame shown in FIG. 7 using the techniques of the present invention. The omission of the fasteners reduces the weight of the frame by the weight of the fasteners and this can have a significant advantage particularly in military aircraft.

We claim:

1. A structure for use in constructing aircraft comprising a central member and at least one cantilever rib extending outwardly therefrom, the rib having a free edge unattached to any other portion of said structure and a proximal edge which is joined to the central member, wherein the rib is formed by doubled-back portions of superplastically formable material that have been bonded together.

2. A structure as claimed in claim 1, wherein the central member is in the form of a planar sheet.

3. A structure as claimed in claim 1, wherein ribs are formed on one side only of the central member.

4. A structure as claimed in claim 1, wherein ribs are formed on each of two opposed sides of the central member.

5. A structure as claimed in claim 4, wherein the ribs on the two opposed sides of the central member are located opposite one another.

6. A structure as claimed in claim 1, wherein each rib defines a closed loop continuously extending around the perimeter of an area of the structure.

7. A structure as claimed in claim 1, selected from the group consisting of a beam, bar, strut or frame.

* * * * *